US005911602A

United States Patent [19]

Vaden

[11] Patent Number: 5,911,602

[45] Date of Patent: Jun. 15, 1999

[54] REDUCED CROSS TALK ELECTRICAL CONNECTOR

[75] Inventor: Sterling A. Vaden, Black Mountain, N.C.

[73] Assignee: Superior Modular Products Incorporated, Swannanoa, N.C.

[21] Appl. No.: 08/896,466

[22] Filed: Jul. 18, 1997

Related U.S. Application Data

[63] Continuation-in-part of application No. 08/685,167, Jul. 23, 1996, Pat. No. 5,674,093.

[51] Int. Cl.[6] ..... H01R 23/02

[52] U.S. Cl. ..... 439/676; 439/941

[58] Field of Search ..... 439/941, 676, 439/344, 60, 630, 636, 637, 924.1, 924.2

[56] References Cited

U.S. PATENT DOCUMENTS

| | | | |
|---|---|---|---|
| 4,274,691 | 6/1981 | Abernethy et al. | 439/676 |
| 4,406,509 | 9/1983 | Jagen | 439/676 |
| 4,941,830 | 7/1990 | Tkazyik et al. | 439/630 |
| 5,011,435 | 4/1991 | Seong et al. | 439/676 |
| 5,052,936 | 10/1991 | Biechler et al. | 439/60 |
| 5,299,956 | 4/1994 | Brownell et al. | 439/638 |
| 5,362,257 | 11/1994 | Neal et al. | 439/676 |
| 5,387,135 | 2/1995 | Shen et al. | 439/676 |
| 5,399,107 | 3/1995 | Gentry et al. | 439/676 |
| 5,586,914 | 12/1996 | Foster, Jr. et al. | 439/676 |
| 5,639,266 | 6/1997 | Patel | 439/676 |
| 5,759,070 | 6/1998 | Pelopolsky | 439/676 |

FOREIGN PATENT DOCUMENTS

| | | |
|---|---|---|
| 0 674 364 A1 | 9/1995 | European Pat. Off. . |
| 0782221 A2 | 7/1997 | European Pat. Off. . |
| 2 273 397 | 1/1997 | United Kingdom . |
| WO 96/32831 | 10/1996 | WIPO . |
| WO 96/37017 | 11/1996 | WIPO . |

OTHER PUBLICATIONS

"Category 5 Performance Modular Plug and Jack System", issued 1995, *Stewart Connector*.

*Primary Examiner*—Paula Bradley
*Assistant Examiner*—Tho D. Ta
*Attorney, Agent, or Firm*—Carter & Schnedler, P.A.

[57] ABSTRACT

There is provided an electrical connector, including a housing which receives a plurality of elongated contacts for receiving electrical signals. Each contact includes a free end. Each contact having a major bend therein. At least a portion of adjacent contacts between their respective free ends and major bends are not parallel so that electrical signal transmission of the connector is enhanced.

9 Claims, 6 Drawing Sheets

Prior Art

*Prior Art* Fig. 10

REDUCED CROSS TALK ELECTRICAL CONNECTOR

RELATED APPLICATION

This is a continuation-in-part of U.S. application Ser. No. 08/685,167 filed on Jul. 23, 1996 now U.S. Pat. No. 5,674,093 by Sterling A. Vaden, titled "REDUCED CROSS TALK ELECTRICAL CONNECTOR" and assigned to Superior Modular Products Incorporated.

BACKGROUND OF THE INVENTION

This invention relates to reducing electrical signal interference which arises electrical connectors having closely spaced contacts. More particularly it relates to the reduction of cross talk induced by closely spaced contacts in Federal Communications Commission (FCC) type modular jacks and plugs and other signal connectors.

The FCC has adopted certain architectural standards with respect to electrical connectors utilized in the telecommunication industry so as to provide intermatability. The connectors that are most commonly utilized are FCC type modular plugs and jacks. The plug is terminated to a plurality of wires which may be connected to a telephone handset or other communication device. The corresponding jack is often mounted to a panel or printed circuit board which in turn is connected to a telecommunication network. The jack may also include a lead frame, whereby the printed circuit board is eliminated and a plurality of wires are terminated to the jack via insulation displacement contacts which are integral with the lead frame.

A typical FCC jack is described in U.S. Pat. No. 4,648,678 issued to Archer. The Archer jack includes a plurality of closely spaced parallel electrical contacts. Typically, the closely spaced parallel contacts are mounted to a nose piece as shown in FIG. 1. Nose piece 10 includes a plurality of contacts 12 mounted thereto. Contacts 12 are divided into pairs forming so-called signal pairs. Because these contacts are so closely spaced due to FCC constraints and are parallel to one another, pair to pair cross talk is induced. This cross talk is primarily due to capacitive and inductive couplings between adjacent conductors. Since the extent of the cross talk is a function of the frequency of the signal on a pair, the magnitude of the cross talk is logarithmically increased as the frequency increases and is commonly expressed as ten times the log of the ratio of the cross talk energy divided by the signal energy (decibels or DB).

As FCC modular jacks and plugs are utilized more in high frequency data and communication applications, cross talk, which arises in adjacent and parallel contacts within the jack, has become an industry problem. U.S. Pat. No. 5,299,956 issued to Brownell and Vaden, and assigned to Superior Modular Products, Inc., assignee of this invention, teaches the cancellation of the cross talk arising in the jack by utilizing a capacitance formed on the circuit board which is connected to the jack. U.S. Pat. No. 5,186,647 issued to Denkmann et al teaches of the reduction of cross talk in an electrical connector by crossing over conductors of a lead frame in an electrical connector. A design which incorporates some of the concepts taught by Denkmann et al is shown in FIG. 10.

While the Brownell/Vaden and the Denkmann approaches to cross talk reduction have significantly reduced cross talk and have met with substantial commercial success, there remains a need to further enhance the performance of FCC type connectors, particularly as frequencies increase.

U.S. Pat. No. 5,399,107 issued to Gentry et al shows a modular jack which achieves enhanced cross talk performance by utilizing alternating long and short electrical contacts so that not all portions of the adjacent contacts are immediately adjacent. The alternating Gentry contacts are illustrated in a simplified form in FIG. 2 as short contact 60 and long contact 62. However, the resiliency of the short contact 60 of Gentry is compromised due to its length.

Stewart Stamping Company sells a reduced cross talk connector where the reduction is achieved by the configuration of adjacent contacts, however, the adjacent contacts do not have major first bends in the same direction like the typical contacts shown in FIG. 1. In addition, the Stewart design reduces longitudinal balance.

OBJECTS OF THE INVENTION

It is therefore one object of this invention to provide a low cross talk electrical signal transmission system.

It is another object to provide an electrical connector which is designed to reduce cross talk between signal pairs.

It is another object to provide a reduced cross talk electrical connector which does not degrade longitudinal balance.

It is yet another object to provide contacts for a reduced cross talk electrical connector where the resiliency of the contacts are not compromised.

SUMMARY OF THE INVENTION

In accordance with one form of this invention, there is provided an electrical connector including a housing which receives a plurality of elongated contacts. The contacts are adapted to receive electrical signals. The plurality of contacts includes a first contact and a second contact which are adjacent to one another. Each contact includes a first bend defining upper and lower portions of the contact. At least a part of the upper portion of the first contact is not parallel to a part of the upper portion of the second contact, whereby electrical signal transmission characteristics of the connector is enhanced.

Preferably the first contact has a second bend which is curved in the reversed direction from the first bend. It is also preferred that each of the contacts are substantially the same length so that longitudinal balance is not degraded.

Also preferably, the first contact includes a third bend which is curved in the same direction as the first bend. Thus, a substantial portion of adjacent contacts are maintained a distance from one another and are not parallel to one another so that capacitive coupling is reduced. Also it is preferred that the alternate contacts are the same shape, which will further enhance cross talk reduction due to a capacitive decoupling affect between such contacts.

In accordance with another form of this invention, there is provided an electrical connector including first, second, third, fourth, fifth, sixth, seventh and eighth conductors; a first part of each of the conductors forming a spring contact; second parts of the conductors forming a lead frame; the first part of the first conductor being adjacent to the first part of the second conductor, the first part of the second conductor being adjacent to the first part of the third conductor, the first part of the third conductor being adjacent to the first part of the fourth conductor, the first part of the fourth conductor being adjacent to the first part of the fifth conductor, the first part of the fifth conductor being adjacent to the first part of the sixth conductor, the first part of the sixth conductor being adjacent to the first part of the seventh conductor, and the first part of the seventh conductor being adjacent to the first part of the eighth conductor; the second part of the conductors crossing over one another, wherein the second part of the first conductor is located between the second part of the second conductor and the second part of the fourth conductor, the second part of the third conductor is located between the second part of the sixth conductor and the second part of the fifth conductor, and the second part of the eight conductor is located between the second part of the fifth conductor and the second part of the seventh conductor; the first and second conductors, the fourth and fifth conductors, the third and sixth conductors, and the seventh and eighth conductors forming signal pairs; portions of the first parts of the first, third, fifth, and seventh conductors are not parallel to portions of the first parts of the second, fourth, sixth, and eighth conductors, whereby cross talk between the signal pairs is substantially reduced and return loss is substantially improved.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENT

Figure 3:
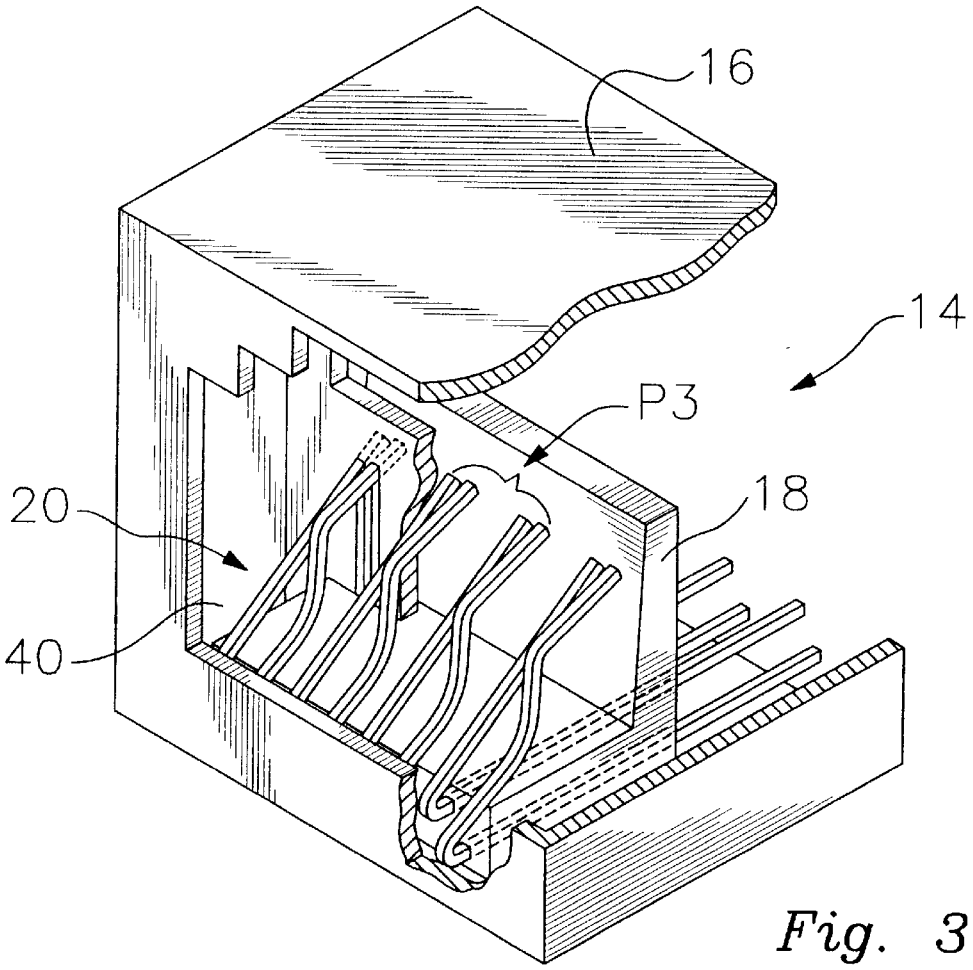
FIG. 3 is a partial pictorial view of the apparatus of the subject invention.

Referring now more particularly to FIG. 3, there is provided FCC type modular jack 14 including a housing 16 and a contact carrier 18. In this embodiment eight spring contacts 20 are mounted on contact carrier 18. It is preferred that the contacts be made of copper alloy or bronze alloy.

Figure 4:
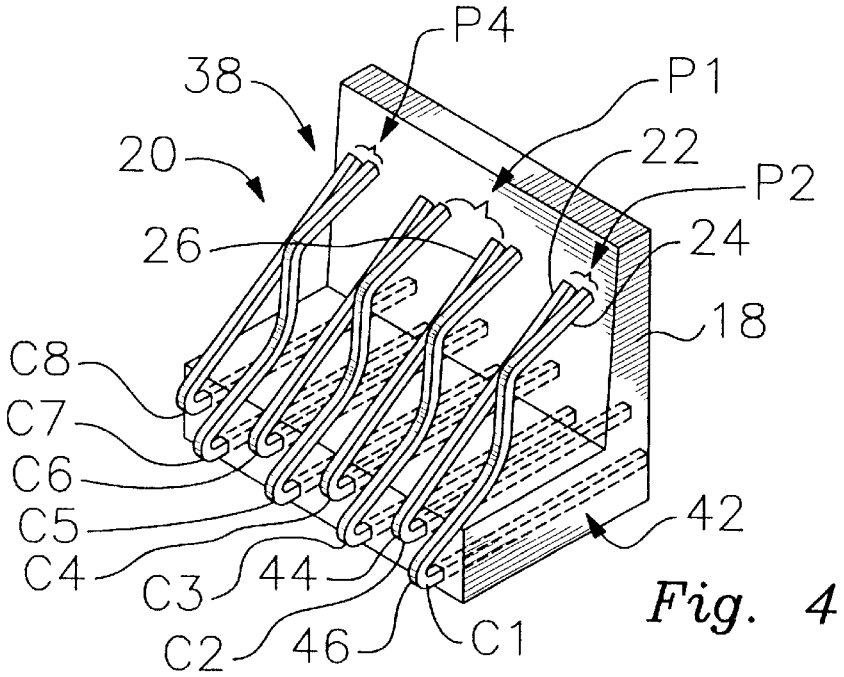
FIG. 4 is a pictorial view of the contact carrier and contacts of the embodiment of FIG. 3.
Figure 5:
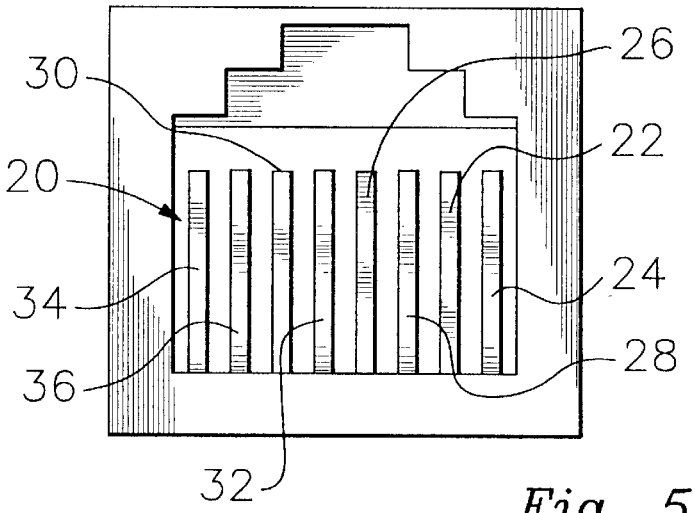
FIG. 5 is a front elevational view of the embodiment of FIG. 3.

The relationship between the contact carrier 18 and the contacts 20 is better shown in reference to FIGS. 4 and 5. Contacts 22, 24, 26, 28, 30, 32, 34 and 36 are closely spaced electrical spring contacts which make contact with fixed contacts in a corresponding FCC type modular plug (not shown). Certain pairs of these contacts forms parts of electrical circuits.

The contacts 20 include deflectable upper portions 38 which provide forces on the corresponding contacts in the plug when the plug is inserted into the opening 40 of housing 16. The contacts 20 also include lower substantially fixed portions 42, two conductors of which are shown as dotted lines in FIG. 4 for illustration purposes. The lower portions are held together in contact carrier 18. The contacts 22 through 36 include alternating adjacent contacts made of two different designs in the upper regions 38 thereof.

Figure 1:
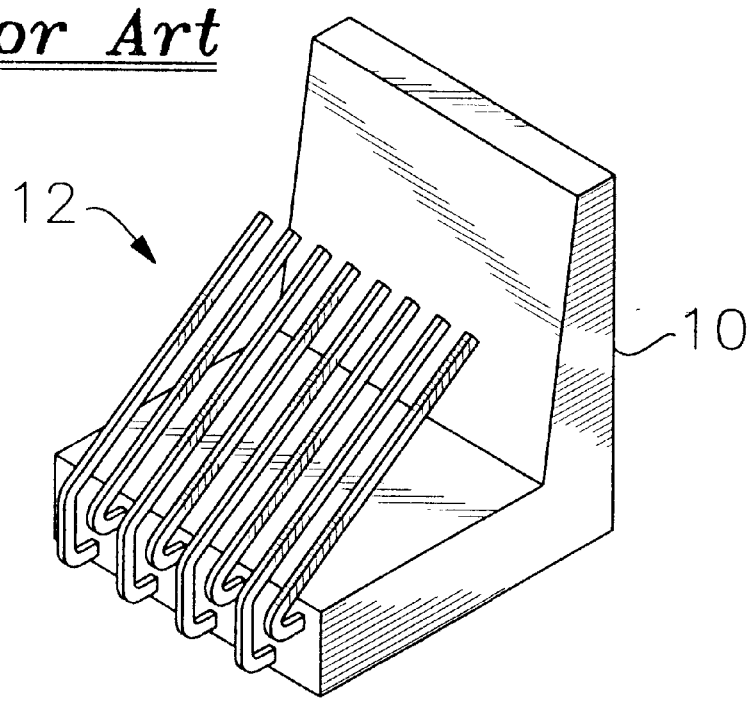
Fig. 1 Prior Art
FIG. 1 is a pictorial view of a contact carrier and associated contacts from a prior art electrical connector.
Figure 2:
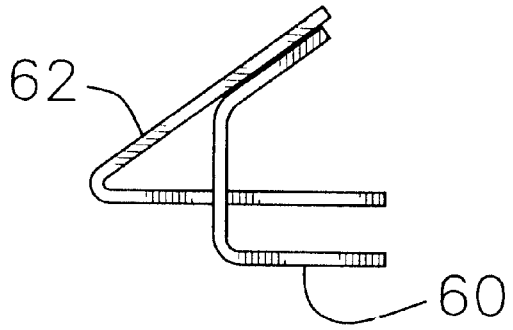
FIG. 2 is a side elevational view showing a pair of adjacent contacts from another prior art electrical connector.

Contacts 22, 26, 30 and 34 form one group of contacts and are of a standard design similar to contacts 12 shown in FIG. 1. That is, contacts 22, 26, 30 and 34 include a single major, first bend 44 as best shown in FIGS. 7 and 8.

Figure 6:
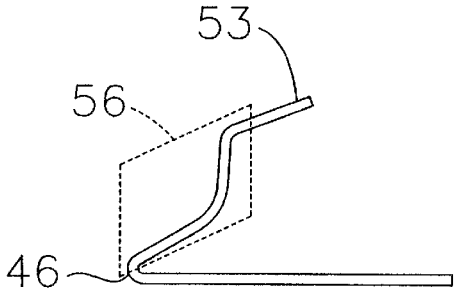
FIG. 6 is a side elevational view of one of the contacts from FIG. 4 having a reverse bend with a dotted line box showing the region of the contact which is not parallel and closely spaced to its adjacent contact.
Figure 8:
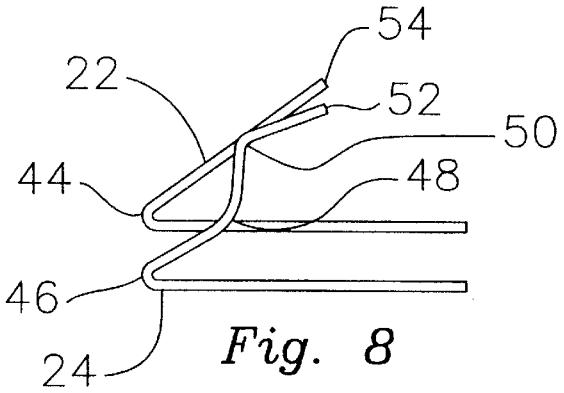
FIG. 8 is a side elevational view of a pair of adjacent contacts from the embodiment of FIG. 3.

Contacts 24, 28, 32 and 36 form another group of contacts and are designed with three bends which are best seen in reference to FIGS. 6 and 8. Contacts 22, 26, 30 and 34 have a different profile from contacts 24, 28, 32 and 36. Contact 24 which is identical to contacts 28, 32 and 36 includes a first bend 46 which is similar to bend 44 of contact 22. Contact 24 further includes a second bend 48 which is curved in the reverse direction from first bend 46. Contact 24 further includes a third bend 50 which is curved in the same direction as first bend 46. The upper portion of contact 24 presents somewhat of a "S" shaped profile.

The portions of both contacts 24 and 22 near their respective free ends 52 and 54 make contact with the associated plug contacts (not shown).

Figure 7:
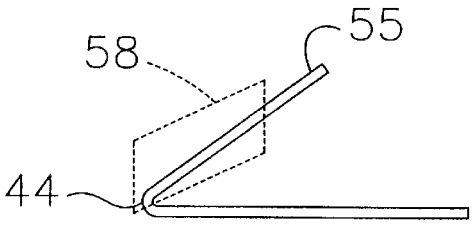
FIG. 7 is a side elevational view of another of the contacts from FIG. 4, which is adjacent to the contact shown in FIG. 6 with a dotted line box showing the region of the contact which is not parallel and closely spaced to its adjacent contact.

As can be seen better by reference to FIGS. 6, 7 and 8, there are regions in the upper portions of the contacts 24 and 22 between the respective bends 44 and 46, and the plug contact making portions of 53 and 55 which are not closely spaced and are not parallel to one another. Those regions are illustrated by dotted rectangular boxes 56 and 58.

Figure 9:
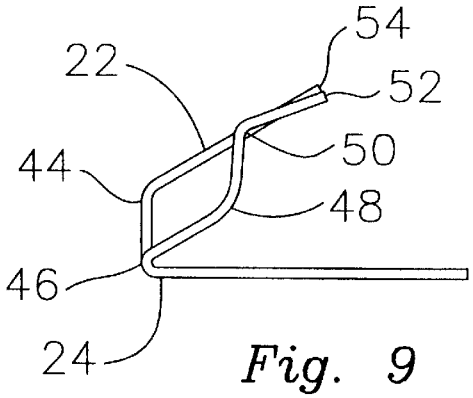
FIG. 9 is a side elevational view of a pair of adjacent contacts showing an alternative embodiment to FIG. 8.

The contact pair shown in FIG. 9 is substantially identical to those shown in FIG. 8, except that the lower portions of the two contacts are in the same plane.

It has been found by utilizing alternating contacts 24, 28, 32 and 36 contain the additional two bends 48 and 50 adjacent to standard contacts 22, 26, 30 and 34, cross talk which occurred in the prior art connector shown in FIG. 1 has been substantially reduced. Near end cross talk measurements at 100 MHz have been taken for this improved design connector, comparing the results directly to results from the conventional connector of the type shown in FIG. 1 having otherwise substantially the identical basic construction. The measurements were taken in accordance with the arrangement set forth below.

Printed Circuit Board Arrangement of Conductors

| Pair Number | Conductor Numbers | Pair Combination | Primary NEXT Contributors (Conductor #s) |
|---|---|---|---|
| P1 | C4–C5 | P1–P2 | C2–C4 |
| P2 | C1–C2 | P1–P3 | C3–C4 and C5–C6 |
| P3 | C3–C6 | P1–P4 | C5–C7 |
| P4 | C7–C8 | P2–P3 | C2–C3 |
| | | P2–P4 | C2–C7 |
| | | P3–P4 | C6–C7 |

The connector tested was constructed substantially similarly to the connector shown in FIGS. 3 and 4, although, the alternating S curved and straight conductor contacts were reversed. That is, the connector tested was designed with conductor contacts C2, C4, C6 and C8 having the S curved conductor contacts for cross talk reduction. However, for ease of illustration and understanding, the test results will be described in reference to the connector construction shown in FIGS. 3 and 4. The cross talk occurs between conductors C2 and C3, conductors C4 and C3, conductors C5 and C6, and conductors C6 and C7. The cross talk reduction appears on pairs P2-P3, P1-P3, P2-P4, and P3-P4. The other pair combinations are relatively unaffected. This is confirmed by the test data, where each pair combination was tested with five different modular plugs numbered Pg1 through Pg5. Five plugs were used to confirm NEXT improvement across a range of plugs with differing NEXT values.

The results of the measurements in DB are shown in the tables set forth below:

Near End Cross Talk Category 5 @ 100 MHz
Prior Art vs. Invention

| Pairs 1–3 | Prior Art | Invention |
|---|---|---|
| Pg1 | −33.82 DB | −36.38 DB |
| Pg2 | −34.13 | −36.98 |
| Pg3 | −34.44 | −37.20 |
| Pg4 | −37.10 | −41.02 |
| Pg5 | −37.33 | −41.28 |
| **Pairs 2–3** | **Prior Art** | **Invention** |
| Pg1 | −49.72 DB | −56.87 DB |
| Pg2 | −47.87 | −52.86 |
| Pg3 | −54.20 | −60.15 |
| Pg4 | −45.09 | −49.18 |
| Pg5 | −46.26 | −50.09 |
| **Pairs 2–4** | **Prior Art** | **Invention** |
| Pg1 | −63.73 DB | −65.59 DB |
| Pg2 | −66.52 | −69.70 |
| Pg3 | −64.82 | −66.68 |
| Pg4 | −66.65 | −69.05 |
| Pg5 | −66.36 | −69.63 |
| **Pairs 3–4** | **Prior Art** | **Invention** |
| Pg1 | −52.98 DB | −56.21 DB |
| Pg2 | −48.82 | −53.18 |
| Pg3 | −53.09 | −57.01 |
| Pg4 | −49.48 | −54.20 |
| Pg5 | −46.34 | −49.79 |

The improvement for pairs P1-P3, P2-P3, and P3-P4 are particularly notable. Thus, within experimental variation, the improvement in NEXT improves as a function of plug NEXT across all five plugs for pairs P1-P3, P2-P3, P2-P4, and P3-P4, as summarized below.

| Pair Combination | Primary NEXT Contributors (Conductor #s) | Reverse Curve Conductor # | Resulting NEXT Reduction |
|---|---|---|---|
| P1–P3 | C3–C4 and C5–C6 | C3,C5 | 2.5 to 3.9 DB |
| P2–P3 | C2–C3 | C3 | 3.5 to 7 DB |
| P2–P4 | C2–C7 | C7 | 2–3 DB |
| P3–P4 | C6–C7 | C7 | 3.2 to 4.7 DB |

In addition, due to the two extra bends 48 and 50 in contact 24, the lengths of each contact are substantially equal so that the longitudinal balance as described in CCITT recommendations 0.9 is preserved.

Figure 10:
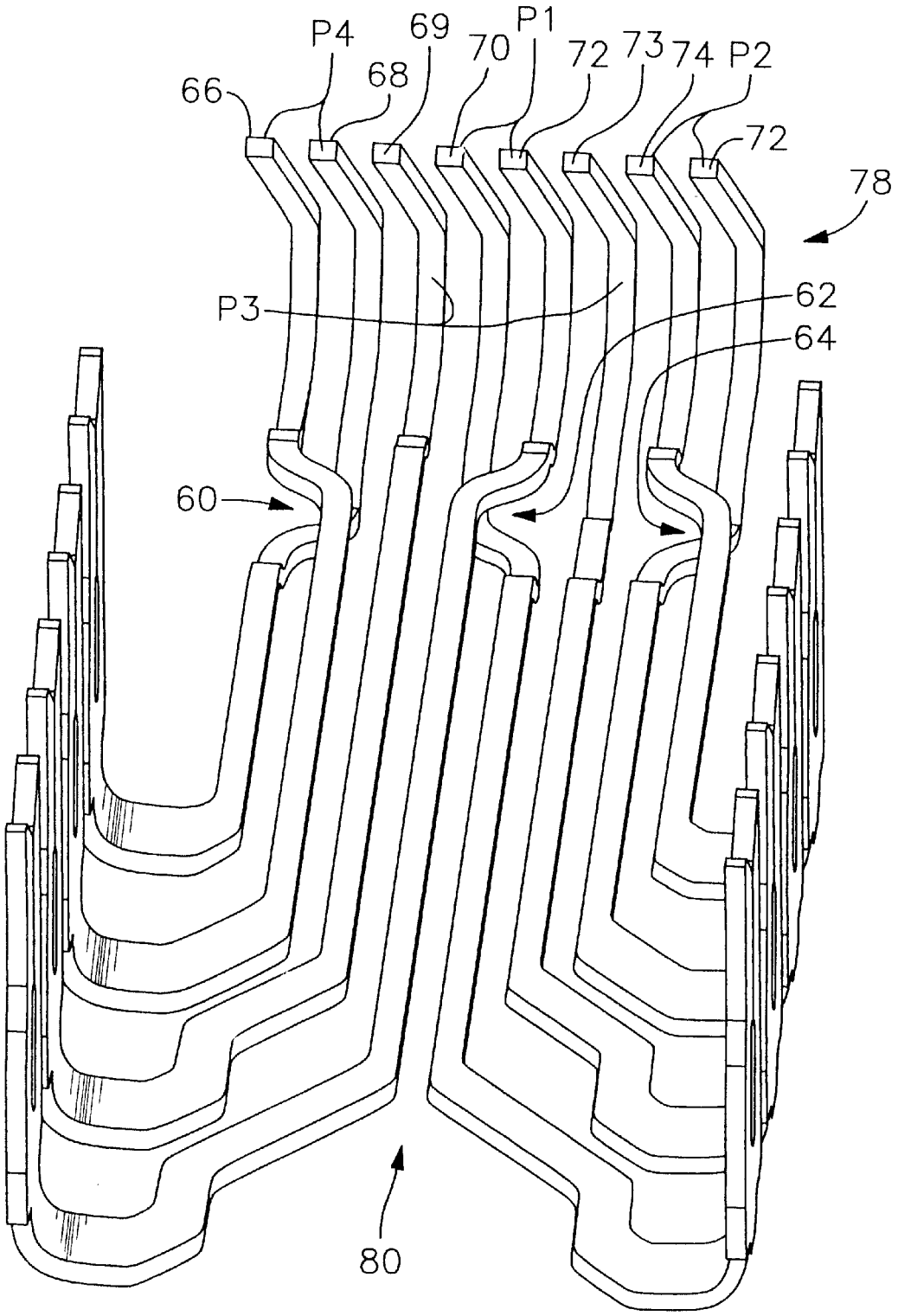
FIG. 10 is a pictorial view of a prior art lead frame design.

The invention described above is applicable to connectors which utilize capacitance decoupling on a circuit board, e.g., the Brownell et al patent, as well as crossed lead designs, e.g., the Denkmann et al patent, as primary cross talk reduction techniques. A prior art lead frame jack as described in the Denkmann is shown in FIG. 10. The input array consists of a simple linear array of conductors which is substantially similar to the entirety of the simple jack shown in FIG. 1. Crossover points 60, 62 and 64 are provided respectively for conductors 66 and 68, 70 and 72, and 74 and 76 which defines the transition from input portion 78 of the array to output portion 80. By means of these crossovers, the near end cross talk is substantially cancelled. Specifically, conductor 70 which is close to conductor 69 and conductor 72 which is close to conductor 73 which generate cross talk through electro-magnetic couplings in the input portion of pair P1 and pair P3, are positioned close to conductors 73 and 69 respectively. Similarly, the cross talk generated in pair combination P2-P3 is cancelled by placing conductor 66 next to conductor 69, and cross talk generated in pair combination P3-P4 is cancelled by placement of conductor 76 next to conductor 73. This results in a successful design which cancels the cross talk in the worst three contributors in the simple jack design. There are two deficiencies in this design, however, which will be addressed by the improved design depicted below. The first is that the simple array generates cross talk between pair combinations that is substantially worse than that of the prior art jack shown in FIG. 1. This limits the relative improvement that can be gained through cross talk cancellation by reorientation of conductor positions. The second deficiency is that the characteristic impedance of pair P3, which is determined by the geometric relationship of conductors 69 and 73 with each other is degraded with respect to pairs P1, P2 and P4.

Figure 11:
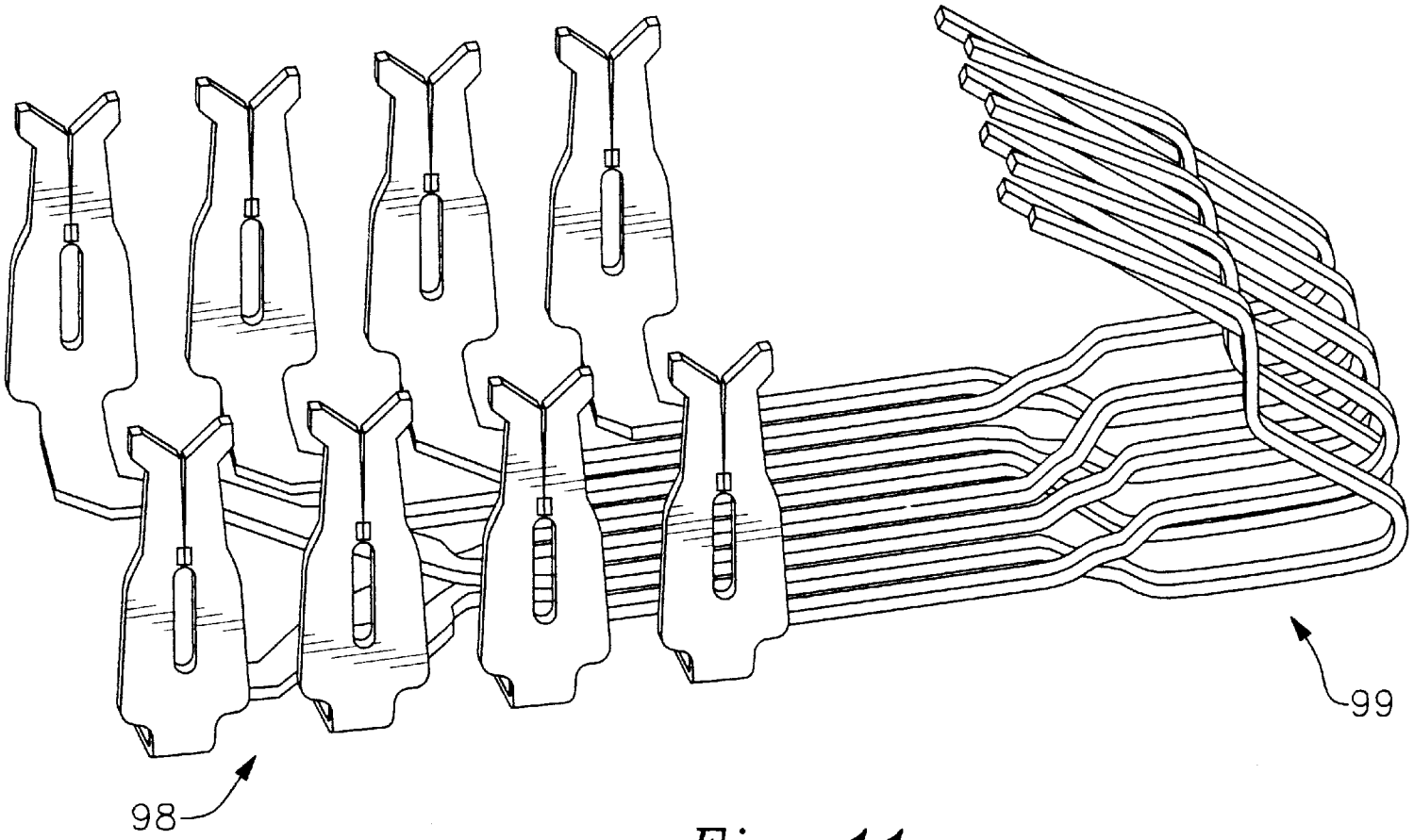
FIG. 11 is a pictorial view of a lead frame embodiment of the apparatus of the subject invention.
Figure 12:
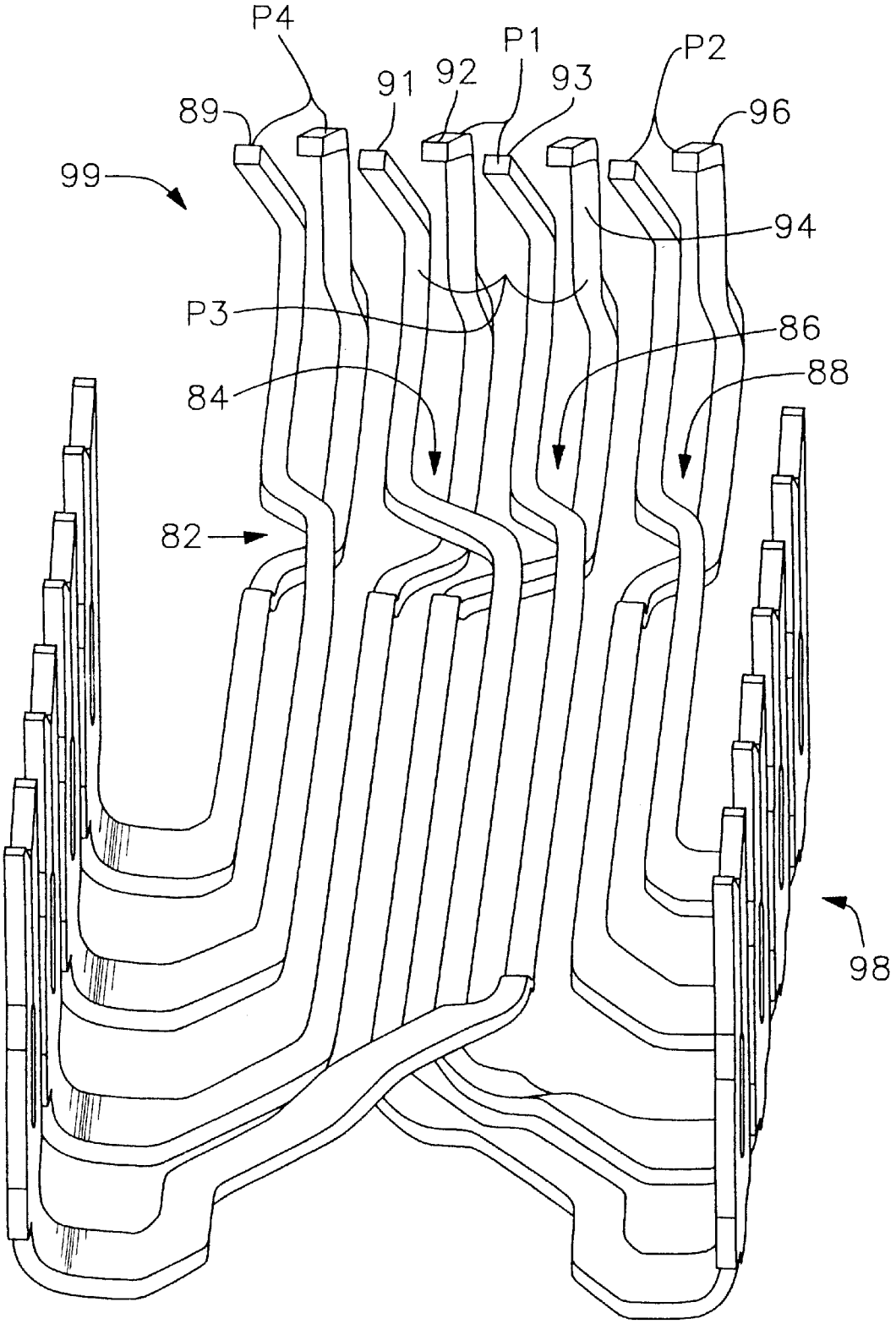
FIG. 12 is a pictorial view of the lead frame apparatus of FIG. 11 shown at a different angle.

An enhanced lead frame jack incorporating the invention described above has been designed to address the two deficiencies stated above. The contact arrangement is depicted in FIGS. 11 and 12. In this case, the input array, with the alternating S shaped designed contacts described above, is substantially similar to the jack shown in FIGS. 3 and 4. This reduces the cross talk generated in the input array as stated previously and shown in the table. The conductor crossover points 82, 84, 86 and 88 have been redesigned to reposition conductor 89 next to conductor 92 in the output portion 98 of the array to substantially cancel pair to pair cross talk P1-P2. Similarly, conductor 96 is positioned next to conductor 93 in the output portion 98 of the array, to substantially cancel pair to pair cross talk due to P1-P4. Conductor 92 is placed next to conductor 94, and conductor 93 is placed next to conductor 91 in the output portion 98 of the array as in the Denkmann et al patent shown in FIG. 10. But the conductors 91 and 94 are now moved together in the center between conductors 92 and 93. This arrangement differs from Denkmann, which placed conductors 92 and 93 in the center of the array in the output portion and does not move conductors 91 and 94 from their respective positions from input to output as shown in FIG. 10.

The above arrangement of conductors in the output portion 98 of the array in the enhanced lead frame has the effect of improving the structural return loss of pair P3 (conductors 91 and 94) which has the conductors widely spaced in the input portion 99 of the lead frame due to the pair designation requirements of TIA 568 telecommunications standard. The placement of the conductors in close proximity in the output portion of the array results in an improvement in return loss as illustrated in the table set forth below.

RETURN LOSS MEASUREMENTS

| | DENKMANN | | ENHANCED LEAD FRAME | |
|---|---|---|---|---|
| | Plug Cal | Balun Cal | Plug Cal | Balun Cal |
| P1 | −22.04 | −21.15 | −21.24 | −20.46 |
| P2 | −28.64 | −22.62 | −24.80 | −20.47 |
| P3 | −21.11 | −18.05 | −25.12 | −20.48 |
| P4 | −28.18 | −26.86 | −24.50 | −23.71 |

Contact 94 is brought to the center and placed next to 92 in the lower portion. It should be noted that conductors 91 and 94 which were separated in the upper portion are now placed next to each other in the lower portion. This has the effect of improvement of the return loss (structural return loss) as shown above.

This arrangement of conductors as described above and shown in FIGS. 11 and 12 constitutes a novel design which improves the performance characteristics of a lead frame connector assembly.

From the foregoing description of the preferred embodiment of the invention, it will be apparent that many modifications may be made therein. It will be understood, however, that this embodiment of the invention in an exemplification of the invention only and that the invention is not limited thereto. It is to be understood therefore that it is intended in the appended claims to cover all modifications as fall within the true spirit and scope of the invention.

I claim:

1. An electrical connector comprising:

a housing;

said housing receiving a plurality of elongated contacts;

said housing adapted to receive a removable plug whereby said contacts can receive electrical signals from the plug;

said plurality of contacts including a first contact and a second contact;

said first contact being adjacent to said second contact;

each contact including a first bend defining an upper portion and a lower portion of said contact each upper portion having a free end;

the angle between the upper portion and the lower portion being acute; said upper portion being adapted to make contact with and be deflected by the removable plug;

said contacts being formed so that said free end of said upper portion of said first contact is not parallel to said free end of said upper portion of said second contact, irrespective of whether the plug is received in the housing or not, whereby electrical signal transmission characteristics of said connector is enhanced.

2. A connector as set forth in claim 1, wherein said lower portion of said contacts are integral with a lead frame; said lead frame including a plurality of conductors; a number of said conductors crossing each other for reducing cross talk.

3. A connector as set forth in claim 1, wherein the upper portion of said first contact is substantially in the form of a "S".

4. A connect as set forth in claim 1, further including third and fourth contacts;

the upper portion of said third contact being substantially identical to the upper portion of said first contact;

the upper portion of said fourth contact being substantially identical to the upper portion of said second contact;

said third contact being located between said second and fourth contacts.

5. A connector as set forth in claim 4, wherein an amount of cross talk cancellation occurs between said first and third contacts and between said second and fourth contacts when signals exists on said first, second, third and fourth contacts.

6. An electrical connector comprising:

an electrical connector including first, second, third, fourth, fifth, sixth, seventh and eighth conductors;

a first part of each of said conductors forming spring contacts;

second parts of said conductors forming a lead frame;

said first part of said first conductor being adjacent to said first part of said second conductor; said first part of said second conductor being adjacent to said first part of said third conductor; said first part of said third conductor being adjacent to said first part of said fourth conductor; said first part of said fourth conductor being adjacent to said first part of said fifth conductor; said first part of said fifth conductor being adjacent to said first part of said sixth conductor; said first part of said sixth conductor being adjacent to said first part of said seventh conductor; and said first part of said seventh conductor being adjacent to said first part of said eighth conductor;

said second parts of said conductors crossing over one another, wherein said second part of said first conductor is located between said second part of said second conductor and said second part of said fourth conductor; said second part of said third conductor is located between said second part of said sixth conductor and said second part of said fifth conductor; and said second part of said eight conductor is located between said second part of said fifth conductor and said second part of said seventh conductor;

said first and second conductors, said fourth and fifth conductors, said third and sixth conductors, and said seventh and eighth conductors forming signal pairs;

portions of said first parts of said first, third, fifth, and seventh conductors are not parallel to portions of said first parts of said second, fourth, sixth, and eighth conductors;

whereby cross talk between said signal pairs is substantially reduced and return loss is substantially improved;

said first part of each of said conductors includes a first bend defining an upper part and a lower part;

at least a portion of said upper part of one conductor not being parallel to at least a portion of said upper part of its adjacent conductor, whereby electrical signal transmission characteristics of said connector is enhanced;

at least said first conductor includes a second bend in said upper part;

said second bend being curved in a reverse direction from said first bend;

said second bend is in the portion of said upper part of said first conductor which is not parallel to a portion of said upper part of its adjacent conductor.

7. A connector as set forth in claim 6, wherein the upper part of said one conductor is substantially in the form of a "S".

8. A connector as set forth in claim 6, wherein said one conductor includes a third bend in said upper part;

said third bend being curved in the same direction as said first bend.

9. A connector as set forth in claim 8, wherein said third bend is in the portion of the upper part of said first conductor which is not parallel to a portion of said upper part of its adjacent conductor.

* * * * *